United States Patent [19]

Lauter

[11] Patent Number: 4,931,001

[45] Date of Patent: Jun. 5, 1990

[54] APEX SEAL WITH FILLED APERTURE

[75] Inventor: Jonathan M. Lauter, Great Neck, N.Y.

[73] Assignee: Deere & Company, Moline, Ill.

[21] Appl. No.: 309,509

[22] Filed: Feb. 13, 1989

[51] Int. Cl.[5] ..... F01C 19/04

[52] U.S. Cl. ..... 418/113; 277/192

[58] Field of Search ..... 418/113, 123, 124, 119, 418/120, 121, 122; 277/81 P, 192

[56] References Cited

U.S. PATENT DOCUMENTS

| | | | |
|---|---|---|---|
| 3,185,387 | 4/1963 | Paschke | 418/124 |
| 3,207,426 | 9/1965 | Gassmann | 418/124 |
| 3,752,607 | 8/1973 | Bilobran | 418/124 |
| 4,104,011 | 8/1978 | Ernest | 418/121 |
| 4,790,734 | 12/1988 | Eiermann | 418/123 |

*Primary Examiner*—John J. Vrablik
*Assistant Examiner*—David L. Cavanaugh

[57] ABSTRACT

A rotary internal combustion engine includes a rotor with apex seals installed in slots which extend axially through apexes of the rotor. Each apex seal includes at least one passage which extends therethrough in a circumferential direction to equalize gas pressure on opposite sides of the apex seal. An insert formed out of a low friction material is loosely received in each passage to reduce the volume exposed to gas pressure.

3 Claims, 1 Drawing Sheet

APEX SEAL WITH FILLED APERTURE

BACKGROUND OF THE INVENTION

This invention relates to rotary internal combustion engines and more particularly to improved apex seals therefore.

In conventional rotary engines, apex seals are mounted in slots in the rotor. Gas pressure acts on the bottom of the seal and pushes the seal radially outwardly towards sealing engagement with the running surface of the engine housing.

The operating pressures in the working chambers are different from one another so that there is a differential pressure across each apex seal between each two adjacent chambers which urges the apex seal against one side wall and away from the opposite side wall of its apex slot.

Friction between the apex seal and the one slot side wall can interfere with the rapid radial movement of the apex seal which is required for the apex seal to maintain sealing engagement with the running surface. As described in U.S. Pat. No. 3,185,387, it has been proposed to reduce this frictional force by having a passage or passages which extend through the apex seal in the circumferential direction in order to reduce the differential pressure which urges the apex seal into engagement with a side wall of the slot.

However, the apertures in such a design increase the volume exposed to the under seal gas pressure, thus increasing the amount of time required for changes in the under seal pressure to produce corresponding radial movement of the apex seal. This reduces the ability of the apex seal to maintain effective sealing engagement with the housing running surface.

SUMMARY OF THE INVENTION

An object of the present invention is to provide a rotary engine with an apex seal arrangement wherein the apex seal maintains continuous and improved sealing during engine operation.

These and other objects are achieved by the present invention in a rotary internal combustion engine which includes a housing and a rotor movable in the housing and subjected to the pressure of combustion gasses. Apex seals are received by slots located in the apexes of the rotor.

The apex seals move radially within the slots and are in frictional engagement with one or another of the slot side walls. Each seal includes one or more passages which extend through the seal in the circumferential direction to reduce the side area of the seal exposed to differential gas pressure and to equalize gas pressure on opposite sides of the apex seal. Each passage receives a loose fitting insert formed out of a low friction material to reduce the volume within each slot which is exposed to gas pressure.

DETAILED DESCRIPTION

Figure 1:
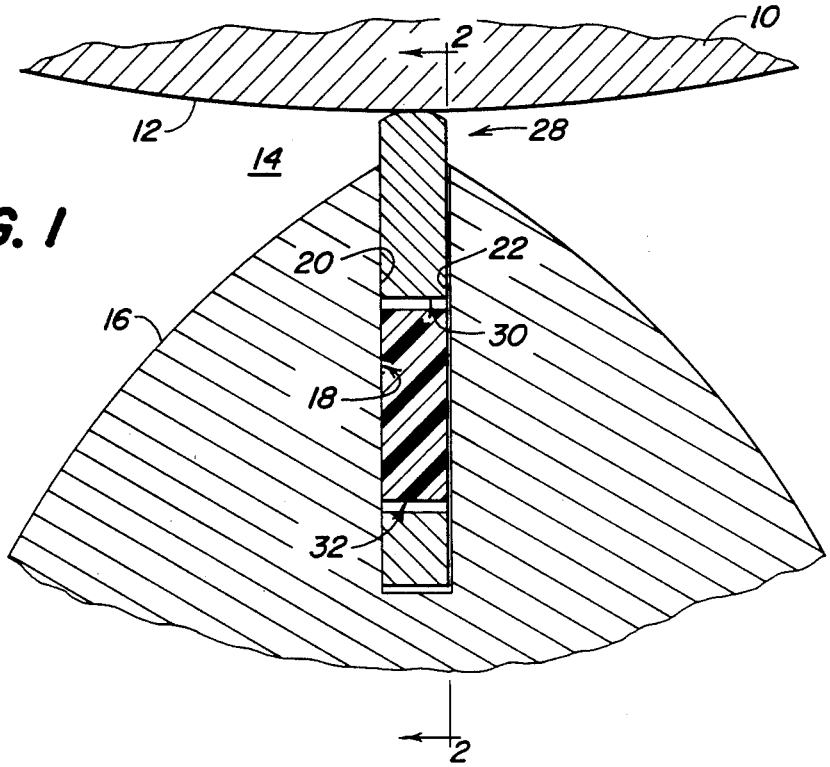
FIG. 1 is a cross-sectional view of the apex seal arrangement of the present invention.
Figure 2:
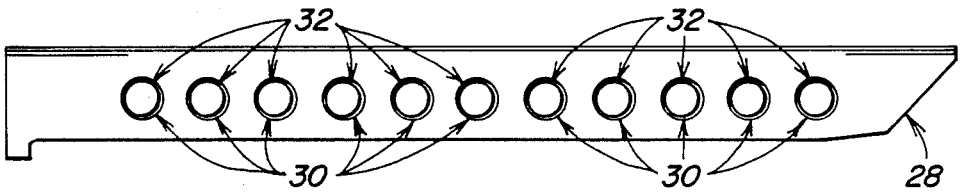
FIG. 2 is a view along lines 2—2 of FIG. 1.

A rotary internal combustion engine of the Wankel type includes a housing 10 which defines an inner running surface 12 which surrounds a working chamber 14. A three-lobed rotor 16 is movable in the chamber 14 about a conventional eccentric (not shown). A slot 18 extends radially and axially through an apex portion of the rotor 16. The slot 18 has side walls 20, 22.

The slot receives an apex seal member 28 which is allowed to move radially within slot 18 in order to remain in contact with the running surface 12. In addition to pressure forces, the apex seal 28 may also be urged radially outwardly by a conventional leaf spring type apex seal spring (not shown).

The seal member 28 includes a plurality of spaced apart apertures 30 which extend through the seal member 28 in a direction which is perpendicular to side walls 20 and 22. The apertures 30 reduce the side area of the seal member 28 which is exposed to differential gas pressure and communicate gas pressure from one side of seal member 28 to its opposite side in order to rapidly equalize gas pressure therebetween and reduce the frictional engagement between seal member 28 and the side walls 20, 22 of slot 18. Each aperture 30 receives a loosefitting cylindrical insert 32 which fills a substantial part of the volume of each aperture and thus reduces the volume upon which the under seal gas pressure must act. Differential gas pressure may move inserts 32 into frictional engagement with side walls 20 or 22. However, such frictional engagement does not hinder the radial movement of the seal member 28 because of the "free-play" between the inserts 32 and the walls of the apertures 30.

Figure 3:
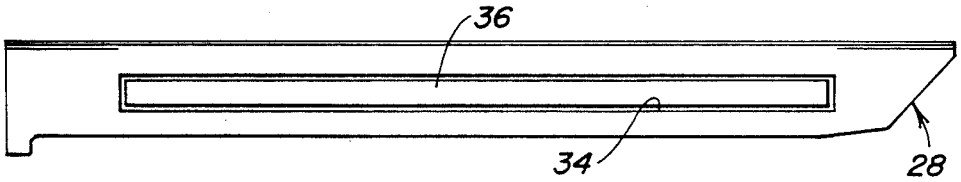
FIG. 3 is a view similar to FIG. 2 of an alternative embodiment of the present invention.

An alternative embodiment is shown in FIG. 3 wherein the seal member 28 includes a single large aperture 34 (which may be of rectangular shape) in which is inserted a single loosefitting low friction insert 36. The inserts are preferably formed out of material which has a lower coefficient of friction than that of apex seal member 28, such as phenolic, Teflon or Polyimide, etc., for example. The resulting seal assembly provides reduced seal side area, reduced side wall friction, and gas pressure equalization while reducing the volume exposed to gas pressure.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. In a rotary engine having a housing defining a working surface surrounding a working chamber, and a rotor movable in the working chamber, and having a slot in an apex portion thereof, the slot having radially and axially extending side walls, and an apex seal mounted in the slot for slidably and sealingly engaging the working surface, the apex seal having at least one aperture extending completely therethrough in a circumferential direction to equalize gas pressure on opposite sides of the apex seal, characterized by:

an insert loosely received in the aperture and frictionally engageable with a side wall of the slot.

2. The invention of claim 1, wherein:

the insert has a coefficient of friction which is lower than the coefficient of friction of the apex seal.

3. The invention of claim 1, wherein:

the apex seal has a plurality of spaced apertures extending completely therethrough to equalize gas pressure on opposite sides of the apex seal; and a plurality of inserts, each insert being slidably engageable with the side walls of the slot and being loosely received in a corresponding one of the plurality of apertures.

* * * * *